United States Patent [19]

Ootaka et al.

[11] 4,386,597

[45] Jun. 7, 1983

[54] EXHAUST GAS RECIRCULATION CONTROL DEVICE FOR AN INTERNAL COMBUSTION ENGINE AND ASSOCIATED METHOD

[75] Inventors: Shoichi Ootaka, Kawagoe; Etsuo Kawabata, Wako; Yutaka Otobe, Niiza; Michio Kawamoto, Tokyo; Norio Sato, Wako, all of Japan

[73] Assignee: Honda Giken Kogyo Kabushiki Kaisha, Tokyo, Japan

[21] Appl. No.: 205,938

[22] Filed: Nov. 12, 1980

[30] Foreign Application Priority Data

Nov. 15, 1979 [JP] Japan ..... 54-147904

[51] Int. Cl.[3] ..... F02M 25/06

[52] U.S. Cl. ..... 123/568; 123/571

[58] Field of Search ..... 123/568, 569, 571

[56] References Cited

U.S. PATENT DOCUMENTS

| | | | |
|---|---|---|---|
| 3,814,070 | 6/1974 | Wertheimer | 123/568 |
| 3,818,880 | 6/1974 | Dawson et al. | 123/568 |
| 3,835,827 | 9/1974 | Wolgemuth | 123/568 |
| 3,861,642 | 1/1975 | Maddocks | 123/568 |
| 3,884,200 | 5/1975 | Caldwell | 123/568 |
| 4,192,278 | 3/1980 | Iizuka et al. | 123/571 |
| 4,208,995 | 6/1980 | Simko et al. | 123/571 |
| 4,235,208 | 11/1980 | Shioya et al. | 123/568 |

FOREIGN PATENT DOCUMENTS 2521681 11/1975 Fed. Rep. of Germany ..... 123/568

*Primary Examiner*—Wendell E. Burns

*Attorney, Agent, or Firm*—Posnack, Roberts, Cohen & Spiecens

[57] ABSTRACT

A method and apparatus for exhaust gas recirculation for an internal combustion engine in which exhaust gas is recirculated through a recirculation passage connecting the exhaust passage of the engine and the intake passage of the engine. A vacuum-response type recirculation control valve is disposed in the exhaust gas recirculation passage to operate in response to vacuum detected at a vacuum detection port located in the intake passage in the vicinity of a throttle valve. A vacuum tank is connected through a solenoid-actuated change-over valve to the vacuum passage interconnecting the vacuum detecting port and the recirculation control valve, the vacuum tank being in communication with the intake passage downstream from the throttle valve through a check valve. A differential pressure switch is connected between the solenoid-actuated change-over valve and a power source and is adapted to be placed in "on" state when the vacuum detected at the vacuum detecting port is lower than the vacuum in the vacuum tank to operate the change-over valve to connect the vacuum tank to the vacuum passage.

17 Claims, 1 Drawing Figure

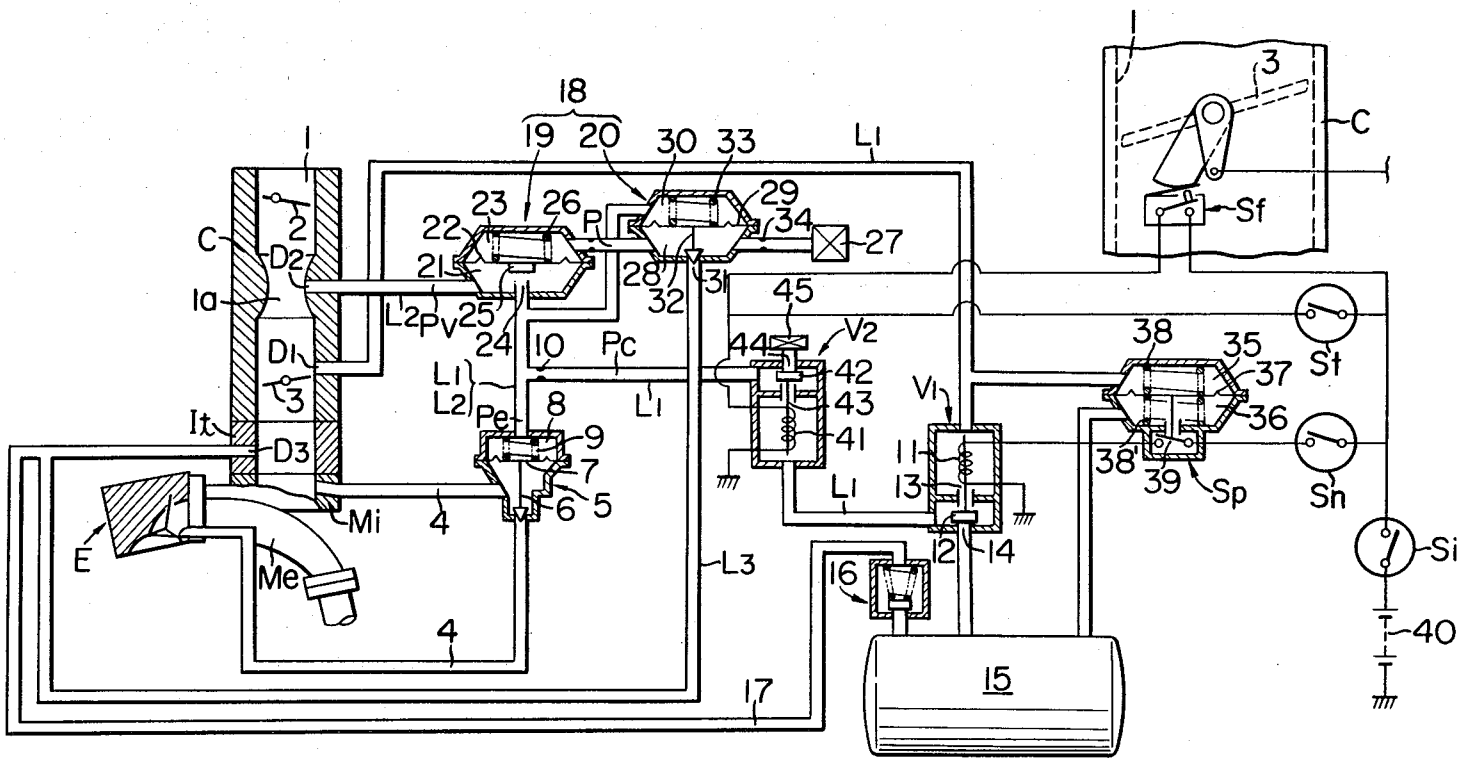
Si
40
C
3
Sf
St
Sn
35
37
36
Sp
38
39
38'
15
14
12
V1
11
13
16
L1
27
V2
42
43
41
45
44
29
34
33
30
31
32
28
L3
17
18
20
19
26
P
Pc
L'1
10
9
7
5
6
8
23
22
21
25
24
Pe
L2
L'2
Pv
4
Mi
Me
1
2
D2
D1
3
D3
C
Ia
It
E

EXHAUST GAS RECIRCULATION CONTROL DEVICE FOR AN INTERNAL COMBUSTION ENGINE AND ASSOCIATED METHOD

FIELD OF THE INVENTION

The present invention relates to a method and apparatus for controlling exhaust gas recirculation mainly for use in vehicle engines, of the type having an exhaust gas recirculation passage connecting the exhaust passage of the engine to the intake passage of the engine, and an exhaust gas recirculation control valve disposed in the exhaust gas recirculation passage to control the rate of exhaust gas recirculation to the intake passage.

PRIOR ART

In the field of automobile engines, it has been adopted to recirculate a part of the exhaust gas to the intake passage to suppress excessive increase of the combustion temperature, thereby to prevent generation of nitrogen oxides which are air polluting components. This type of exhaust gas recirculation control device incorporates an exhaust gas recirculation control valve adapted to operate in response to the intake vacuum of the engine. This known arrangement poses the problem that, as the intake vacuum is lowered by an increase of the opening of the throttle valve during heavy load operation of the engine, the vacuum for operating the exhaust gas recirculation control valve is lowered to decrease the opening of the valve, resulting in an inadequate rate of exhaust gas recirculation.

SUMMARY OF THE INVENTION

The major object of the present invention is to provide an exhaust gas recirculation control device and method capable of overcoming the above-described problem of the prior art device.

Another object of the invention is to provide an exhaust gas recirculation control device and method of the above type adapted mainly for use in vehicle engines, in which the exhaust gas recirculation valve disposed in the exhaust gas recirculation passage interconnecting the exhaust gas passage and the intake passage operates without fail even when the intake vacuum is lowered due to an increase of the throttle valve opening during heavy load operation, thereby to maintain an adequate rate of exhaust gas recirculation.

The invention will be fully described hereafter with respect to a specific embodiment applied to an internal combustion engine of an automobile by way of example, with reference to the accompanying drawing.

BRIEF DESCRIPTION OF THE DRAWING

The sole FIGURE of the drawing is a vertical sectional view of an essential part of a device in accordance with one embodiment of the invention.

DETAILED DESCRIPTION

In the drawing there is seen a portion of an automobile engine E which has an intake manifold Mi and an exhaust manifold Me which are connected to one side of the engine.

A carburetor C is connected to the upstream end of the intake manifold Mi, through the medium of a heat insulating sleeve It. The carburetor C has a choke valve 2 and a throttle valve 3 which are respectively disposed upstream and downstream of a venturi 1*a* of an intake bore 1.

The intake bore 1, heat insulating sleeve It and the intake manifold Mi in combination constitute an intake passage of the engine E. This intake passage is provided with a first vacuum detecting port $D_1$ formed at a portion thereof slightly upstream of the throttle valve 3 in the idle position, a second vacuum detecting port $D_2$ formed in the venturi 1*a* and a third vacuum detecting port $D_3$ formed in the heat insulating sleeve It. The port $D_3$ could also be formed in the intake manifold Mi.

An exhaust gas recirculation passage 4 connects an exhaust port of the engine E to the intake manifold Mi. An exhaust gas recirculation control valve 5 is disposed in the passage 4. The exhaust gas recirculation control valve 5 is of the vacuum response type and comprises a needle valve 6, a diaphragm 7 to which the needle valve 6 is connected and a compression valve spring 9 disposed in a vacuum chamber 8 to bias valve 6 in the closing direction. A first vacuum passage $L_1$ and a second vacuum passage $L_2$ leading from the first and the second vacuum detecting ports $D_1$, $D_2$, respectively, are connected to the vacuum chamber 8.

The first vacuum passage $L_1$ is provided, in the direction going from upstream to downstream, with a first solenoid-actuated change-over valve $V_1$, a second solenoid-actuated change-over valve $V_2$ and an orifice 10. The first solenoid-actuated change-over valve $V_1$ includes a solenoid 11, a valve body 12 adapted to be actuated by the solenoid 11 and a normally opened port 13 and a normally closed port 14 which are adapted to be opened and closed in alternation by the valve body 12. The normally opened port 13 provides, when it is opened, unblocked opening of vacuum passage $L_1$, i.e. communication between the upstream and downstream portions of vacuum passage $L_1$ connected to valve $V_1$, whereas normally closed port 14 provides, when it is opened, communication between a vacuum tank 15 and the downstream side of the first vacuum passage $L_1$. The vacuum tank 15 is connected to the normally closed port 14. The vacuum tank 15 is in communication with the third vacuum detecting port $D_3$ through a vacuum transmitting passage 17 having a check valve 16 therein so that the tank can store the intake vacuum during the engine operation and thereby constitute a vacuum storage means.

The second solenoid-actuated change-over valve $V_2$ includes a valve body 42 adapted to be actuated by a solenoid 41, and a normally opened port 43 and a normally closed port 44 which are adapted to be opened and closed in alternation by the valve body 42. The normally opened port 43 provides, when it is opened, communication between the upstream and downstream sides of the first vacuum passage $L_1$, while the normally closed port 44 provides, when it is opened, communication between the downstream side of the first vacuum passage $L_1$ and an atmospheric port 45 provided with a filter.

A vacuum control valve 18 is disposed in the second vacuum passage $L_2$ and is constituted by a vacuum-response type adjusting valve 19 adapted to open and close the vacuum passage $L_2$ and a vacuum-response type air valve 20 adapted to control the vacuum which operates the adjusting valve 19. The adjusting valve 19 includes a valve chamber 21 formed at an intermediate location along the second vacuum passage $L_2$, a vacuum chamber 23 separated from the valve chamber 21 by a diaphragm 22, a flat valve body 25 on the diaphragm 22 and adapted to open and close a valve port 24 provided at a downstream portion of the second vacuum passage $L_2$ and a valve spring 26 biassing the valve body 25 in the closing direction. The air valve 20 includes a valve chamber 28 at an intermediate location of a third vacuum passage $L_3$ extending between the third vacuum detecting port $D_3$ and an atmospheric port 27 with a filter, a vacuum chamber 30 separated from the valve chamber 28 by a diaphragm 29, a valve body 32 on the diaphragm 29 and adapted to adjust the opening of a valve port 31 at an upstream side of the third vacuum passage $L_3$ and a valve spring 33 biassing the valve body 32 in the closing direction. The valve body 32 has a shape similar to the valve member 6 of the exhaust gas recirculation control valve 5. The vacuum chamber 30 is in communication with the vacuum chamber 8 of the exhaust gas recirculation control valve 5 through the downstream side of second vacuum passage $L_2$ and a portion common to the first and the second vacuum passages $L_1$, $L_2$. An orifice 34 is provided between the valve chamber 28 and the atmospheric port 27.

Throughout the specification, the terms "upstream side of the vacuum passage" and "downstream side of the vacuum passage" are used to refer to the port adjacent to the vacuum side and the side adjacent to the atmospheric port respectively.

Referring now to the control system for controlling the first and second solenoid-actuated change-over valves $V_1$,$V_2$, the control system includes a full-load detecting switch Sf adapted to be turned on upon detection of the substantially fully opened state of the throttle valve 3, a cold state detecting switch St adapted to be turned on upon detection of cold state of the engine, e.g. a temperature of the engine coolant below 60° C., an output rotation detecting switch Sn adapted to be turned on upon detection of a predetermined rotational speed of the engine shaft, e.g. engine speed in excess of 2,500 R.P.M., and a differential pressure switch Sp for comparing the vacuum in the first vacuum detecting port $D_1$ and the vacuum in the vacuum tank 15. The differential pressure switch Sp includes an upper vacuum chamber 35 in communication with the first vacuum detecting port $D_1$, a lower vacuum chamber 36 in communication with the vacuum tank 15, a diaphragm 37 separating the vacuum chambers 35, 36 and a pair of balance spring 38,38' biassing the diaphragm 37 to a neutral position. The arrangement is such that the diaphragm 37 is deflected downwardly to close the switch contact 39 when the vacuum in the upper vacuum chamber 35 is lower than the vacuum in the lower vacuum chamber 36.

The switches Sf and St are connected in parallel with each other between a power source 40 and the second solenoid-actuated change-over valve $V_2$, while the switches Sn and Sp are connected in series between the power source 40 and the first solenoid-actuated change-over valve $V_1$.

In the drawing, reference character Si denotes an ignition switch for the engine E.

The embodiment operates in the manner described hereafter.

When the switches Sf, St and Sn (or Sp) are in the off state to cut off the power supply to the solenoid-actuated change-over valves $V_1$, $V_2$, the vacuum control valve 18 operates as follows. During the operation of the engine, as the throttle valve 3 is suitably opened to generate a vacuum at the downstream side thereof, this vacuum Pc is detected through the first vacuum detecting port $D_1$ (now located downstream of the throttle valve 3) and is transmitted to the vacuum chamber 30 of the air valve 20, via the first and second change-over valves $V_1$, $V_2$ and the orifice 10. As this vacuum is increased to overcome the bias of the valve spring 33, the diaphragm 29 is deflected to raise the valve body 32 to provide communication of the third vacuum passage $L_3$ with valve chamber 28.

As the third vacuum passage $L_3$ is communicated with valve chamber 28, the ambient air sucked through the atmospheric port 27 is sucked into the intake passage of the engine E through the third vacuum passage $L_3$ and the vacuum P generated in the valve chamber 28 of the air valve 20 is transmitted to the vacuum chamber 23 of the adjusting valve 19. As a result, the pressure differential between the vacuum P and the vacuum Pv detected through the second vacuum detecting port $D_2$ acts to deflect the diaphragm 22 upwardly. As the bias of the valve spring 26 is overcome by this upward force, the diaphragm 22 is deflected upwardly to lift the valve body 25 to open the valve port 24. As a consequence, a part of the vacuum Pv is transmitted through the valve port 24 and acts to dilute the vacuum which has passed through the orifice 10 to create a vacuum Pe which is applied to the vacuum chamber 8 to actuate the exhaust gas recirculation valve 5.

As the vacuum is diluted as stated above, the vacuum in the vacuum chamber 30 is lowered i.e. the pressure increases so that the opening of the air valve 20 is decreased correspondingly to reduce the vacuum in the valve chamber 28 and, accordingly, the vacuum in the vacuum chamber 23 of the adjusting valve, thereby to make the valve body 25 close the valve port 24.

Consequently, the vacuum Pe is increased to repeat the same operation. Since this repetition is made at a high frequency, the flow rate of air in the third vacuum passage $L_3$ becomes proportional to the intake air flow rate of the engine E, so that the vacuum P approximates the vacuum Pv.

If the intake air flow rate induced by the engine E is small, the vacuum P assumes a value higher than the vacuum Pv, so that the valve body 25 of the adjusting valve 19 moves in the direction of opening port 24 to lower the vacuum Pe by which the exhaust gas recirculation valve 5 is actuated.

On the contrary, if the intake air flow rate is increased, the vacuum Pv is increased to move the valve body 25 in the direction to close the port 24 to increase the actuating vacuum Pe. Therefore, the air valve 20 and the exhaust gas recirculation control valve 5 operate with the same vacuum Pe. Partly because of this fact and partly because of the similar shape of valve bodies 6 and 32 of these valves 5 and 20, the rate of the exhaust gas recirculation is changed in proportion to the flow rate of air in the third vacuum passage $L_3$, i.e. in proportion to the intake air flow rate. It is, therefore, possible to obtain a constant ratio of the exhaust gas to the total intake mixture induced into the engine.

On the other hand, as both the engine speed detecting switch Sn and the differential pressure switch Sp are turned on to permit the solenoid 11 of the first solenoid-actuated change-over valve $V_1$ to be energized, the valve $V_1$ undergoes a change-over action to provide communication between the vacuum tank 15 and the downstream side portion of the first vacuum passage $L_1$, so that the exhaust gas recirculation control valve 5 is actuated by the vacuum supplied from the vacuum tank 15, irrespective of the vacuum detected through the first vacuum detecting port $D_1$. Thus, during the power-generating operation of the engine, exhaust gas recirculation is performed without fail even if the vacuum detected through the first vacuum detecting port $D_1$ is greatly lowered due to an increase of the opening of the throttle valve 3.

During idling of the engine, however, the output rotation detecting switch Sn is returned to off state, so that the first solenoid-actuated change-over valve $V_1$ is de-energized to cut-off the operation of the vacuum tank 15 and the consequent communication with the first vacuum passage $L_1$. When the throttle valve 3 assumes the idle position, the first vacuum detecting port $D_1$ is positioned upstream of the valve 3 so as to detect the lowered vacuum. In consequence, the vacuum actuating the exhaust gas recirculation control valve 5 is lowered to close the valve 5 thereby to stop the exhaust gas recirculation to stabilize the idling operation of the engine.

As the solenoid 41 of the second solenoid-actuated change-over valve $V_2$ is energized as a result of closing of the full-load detecting switch Sf or the cold-state detecting switch St, the change-over valve $V_2$ undergoes a switching action to permit the downstream side of the first vacuum passage $L_1$ to come into communication with the atmospheric port 45, so that the vacuum Pe for actuating the exhaust gas recirculation control valve 5 is replaced by atmospheric pressure to close the control valve 5. Therefore, during the full load operation of the engine in which the throttle valve 3 is almost fully opened or in the cold state of the engine, the recirculation of the exhaust gas is stopped to increase the engine output.

As has been described, according to the invention, the vacuum tank always storing vacuum is connected through change-over valve $V_1$ to the vacuum passage $L_1$ between the vacuum detecting port $D_1$ opening into the intake passage of the engine and vacuum response type exhaust gas recirculation control valve 5 disposed in the exhaust gas recirculation passage 4, and the vacuum tank is brought into communication with the vacuum passage $L_1$ when the vacuum detected at the vacuum detecting port $D_1$ has dropped. Therefore, the exhaust gas recirculation control valve can operate without fail even when the intake vacuum is reduced due to an increase of the throttle valve opening during heavy load operation of the engine, because the vacuum tank supplies the exhaust gas recirculation control valve with a sufficiently high vacuum to actuate the control valve. In consequence, the exhaust gas recirculation is effected at an adequate rate to greatly contribute to suppress the generation of nitrogen oxide components in the exhaust gas.

What is claimed is:

1. In apparatus for controlling exhaust gas recirculation for an internal combustion engine having an exhaust gas recirculation passage connecting an exhaust passage of the engine to an intake passage of the engine, vacuum-response type control valve means in said recirculation passage for controlling recirculation flow of exhaust gases in said recirculation passage, and vacuum passage means connecting said valve means to said intake passage for operating said valve means in response to the vacuum produced in said intake passage, the improvement comprising vacuum storage means connected to said intake passage at a location downstream of the connection of the vacuum passage means to the intake passage, change-over valve means for selectively connecting said vacuum storage means to said vacuum passage means, and differential pressure switch means connected to said vacuum passage means and to said vacuum storage means for comparing the pressures therein and for selectively operating said change-over valve means in response thereto.

2. The improvement as claimed in claim 1 comprising a check valve connected between said vacuum storage means and said intake passage.

3. The improvement as claimed in claim 1 wherein said change-over valve means comprises a valve member and a solenoid operatively controlling said valve member to alternately connect and disconnect said vacuum storage means to said vacuum passage means.

4. The improvement as claimed in claim 3 comprising and electrical power source and switch means responsive to engine speed selectively connecting said power source to said solenoid.

5. The improvement as claimed in claim 4 wherein said solenoid is energized via said switch means when engine speed exceeds a pre-determined value to connect the vacuum storage means with said vacuum passage means.

6. The improvement as claimed in claim 5 comprising a second change-over valve means including a solenoid, and a valve member controlled by said solenoid, said second change-over valve means being connected in said vacuum passage means downstream of the first said change-over valve means, and further switch means connecting said power source to said solenoid of said second change-over valve means to selectively operate the latter said solenoid.

7. The improvement as claimed in claim 6 wherein said further switch means comprises first and second switches connected in parallel to said electrical power source and said solenoid of said further change-over valve means, said first switch being responsive to engine coolant temperature, said second switch being responsive to position of a throttle valve in said intake passage.

8. The improvement as claimed in claim 6 wherein said valve member of said second change-over valve is operative to selectively connect said vacuum passage means to atmosphere.

9. The improvement as claimed in claim 1 wherein said intake passage includes a throttle valve therein, said vacuum passage means including a first passage having an end connected to a port provided in said intake passage at a location in the vicinity of the throttle valve when the latter is in idle state, and a second passage having an end connected to the intake passage at a venturi thereof, said first and second passages being connected to said control valve means.

10. The improvement as claimed in claim 1 wherein said intake passage therein includes a throttle valve, said vacuum passage means comprising a vacuum passage having one end connected to a port provided in the intake passage at a location in the vicinity of the throttle valve with the throttle valve in idle position, the connection of said vacuum storage means to said intake passage being downstream of said throttle valve, said differential pressure switch means being operative to operate said change-over valve means to connect said vacuum storage means to said vacuum passage means when the vacuum in said vacuum passage means is less than the vacuum in said vacuum storage means.

11. The improvement as claimed in claim 10 comprising a second vacuum passage connected to said intake passage at a venturi thereof located upstream of said throttle valve, a third vacuum passage connected to said intake passage downstream of said throttle valve and vacuum controlled valve means connected to said passages for operating said exhaust gas recirculation control valve means in accordance with the pressures in said passages.

12. Apparatus for controlling exhaust gas recirculation for an internal combustion engine comprising an intake passage for the engine, an exhaust passage for the engine and an exhaust gas recirculation passage connecting the exhaust passage to the intake passage, vacuum-operated control valve means in said recirculation passage responsive to vacuum produced in said intake passage for conrolling recirculation flow of the exhaust gases in said recirculation passage, vacuum storage means for storing vacuum produced in said intake passage and means for subjecting said control valve means to the vacuum in said storage means thereby to open said exhaust gas recirculation passage when engine load exceeds a pre-determined value and the vacuum in said vacuum storage means exceeds the vacuum in said intake passage.

13. Apparatus as claimed in claim 12 comprising means for blocking connection of said vacuum storage means to said control valve means until engine coolant temperature and engine speed reach respective predetermined values.

14. A method for controlling recirculation of exhaust gas for an internal combustion engine from an exhaust passage of the engine to an intake passage of the engine, said method comprising providing a recirculation passage for flow of exhaust gases between the exhaust passage and the intake passage, controlling flow in said recirculation passage by a valve subjected to the vacuum produced in said intake passage at a first location therein, said first location being in the vicinity of a throttle valve in the intake passage when the throttle valve is in idle position, providing, in a tank, vacuum produced in said intake passage at a second location downstream of the throttle valve, comparing the pressures produced at said first and second locations and subjecting the valve to the vacuum in said tank when the vacuum in the tank exceeds the vacuum at said first location.

15. A method as claimed in claim 14 comprising blocking connection of the vacuum in the tank to said valve until engine speed reaches a pre-determined minimum value, engine coolant reaches a pre-determined temperature and engine throttle valve is not fully opened.

16. A method as claimed in claim 15 comprising regulating the vacuum supplied to said valve from said first location by the vacuum in the intake passage at a venturi therein at a location upstream of the first location to provide a substantially constant ratio of exhaust gas recirculation to total intake mixture induced into the engine.

17. A method as claimed in claim 16 wherein the regulating of the vacuum supplied to said valve is controlled by the pressure at said second location.

* * * * *